United States Patent [19]

Hetherington et al.

[11] 4,361,283

[45] Nov. 30, 1982

[54] PLURAL COMPONENT SPRAY GUN CONVERTIBLE FROM AIR ATOMIZING TO AIRLESS

[75] Inventors: Robert D. Hetherington, Sunland; David O'Reilly, Newbury Park, both of Calif.

[73] Assignee: Binks Manufacturing Company, Franklin Park, Ill.

[21] Appl. No.: 186,979

[22] Filed: Sep. 15, 1980

[51] Int. Cl.[3] ..... B05B 7/08; B05B 15/02

[52] U.S. Cl. ..... 239/415; 239/113; 239/419.3; 239/432; 239/528

[58] Field of Search ..... 239/414, 415, 419.3, 239/432, 528, 113, 211, 407, 416.1, 417.5, 422, 424.5, 523

[56] References Cited

U.S. PATENT DOCUMENTS

| | | | |
|---|---|---|---|
| 3,157,361 | 11/1964 | Heavel | 239/415 |
| 3,240,432 | 3/1966 | Boettler | 239/415 |
| 4,099,673 | 7/1978 | Heath et al. | 239/415 |
| 4,175,702 | 11/1979 | Hetherington et al. | 239/415 |

*Primary Examiner*—James B. Marbert
*Attorney, Agent, or Firm*—David O'Reilly

[57] ABSTRACT

A plural component spray gun which can be used as an air atomizing gun for atomizing material at the nozzle for external mixing with a catalyst, and, which is convertible to airless operation. The spray gun has a nozzle body which incorporates passageways for delivering atomizing air and a fluid component to a mixing chamber at the outlet to one of a plurality of nozzles attached to the nozzle body. To convert the spray gun to airless operation, the nozzles are removed, and a sleeve inserted in the air atomizing chamber. One of the nozzles is replaced with an airless type and they are reattached to the gun body. The replaced nozzle has a centrally located annular flange which extends into the air atomizing chamber to hold the sleeve insert in the chamber to seal the air passageway. The centrally located annular flange on the replaced nozzle also includes an annular cavity, into which an insert having an orifice restriction can be inserted for increasing the velocity of the component during airless operation. The spray gun is easily converted back to air atomizing operation by removal of the airless nozzle and sleeve sealing the air passageway and replacement with the air atomizing nozzle.

10 Claims, 5 Drawing Figures

PLURAL COMPONENT SPRAY GUN CONVERTIBLE FROM AIR ATOMIZING TO AIRLESS

BACKGROUND OF THE INVENTION

This invention relates generally to plural component spray systems, and, more particularly, relates to a spray gun which can be easily converted from air atomizing to airless operation which provides external mixing of two components such as catalyst and resin.

In present plural component delivery and sprayin systems, one or more of the components is delivered under high pressure to a nozzle for external mixing with a catalyst. These systems generally use an airless high pressure delivery system which, because of the high pressure, has inherent problems. These high pressure delivery systems also have difficulty in assuring a homogenous mixture, and an incorrect ratio of components can occur because of the very high pressures. Additionally, flushing with an expensive flammable solvent is necessary, because with an internal mixing there is a resin set-up inside the gun from cross-feeding to catalyst passages which could severely damage the gun, or at least render the gun useless until clogged passageways are cleared. After resin set-up, cleaning can be a difficult and time consuming process, if not altogether impossible.

As a solution to the problem, an air atomizing gun was developed, and is disclosed and claimed in U.S. Pat. No. 4,175,702, issued Nov. 27, 1979, to the same assignee as the present invention. In the spray gun disclosed and claimed in this patent, a nozzle gun body having an air delivery passageway, delivers air to a chamber adjacent the outlet to the nozzle for spraying one of the components. In this chamber, the component is atomized by turbulence created in the air flow, providing an air atomized or nucleating system for delivering resin and air, or atomized resin to the fluid tip for external mixing with catalyst.

SUMMARY OF THE INVENTION

The purpose of the present invention is to provide a plural component spraying system and gun having an external mix spraying of plural components, which is convertible from air atomizing of one of the components to airless operation.

This invention is related to and is an improving modification of the air nucleating spray gun disclosed and claimed in U.S. Pat. No. 4,175,702, issued Nov. 27, 1979, incorporated herein by reference, and assigned to the same assignee as the present invention.

The present invention provides an improving modification of the air nucleating or atomizing spray gun of the above identified patent in that the gun can be quickly and easily converted to airless operation at relatively low pressures. In the air atomizing gun, a nozzle body is provided with an air passageway for atomizing a resin in a chamber at the exit to a nozzle. This improving modification includes a sleeve for insertion into the air atomizing chamber to seal the air passageway allowing airless operation. In addition, a spray nozzle tip is provided having an annular flange for holding the sleeve in the chamber and assisting in the sealing of the air passageway. The air passageway is sealed to prevent the component being delivered to the nozzle tip from "backing up" into the air passageway and clogging it. The annular flange for holding the sleeve in the chamber to seal the air passageway also has a cavity for receiving an orifice restriction for increasing the velocity of the component being delivered to the nozzle, if needed.

The advantage of the relatively low pressure airless operation is that there is less overspray, thus reducing misting and spread of the component reducing pollution problems. Further, most material being delivered to the nozzle will go on the substrate providing a more efficient operation. An additional advantage is that no solvent purging is necessary because the mixing will be entirely external. The airless operation is also particularly suited for large projects because it will save time by allowing a greater volume of material to be delivered to the substrate. The conversion to low pressure airless operation is particularly advantageous where overspray and air pollution caused by excessive misting from air atomized operation can result. It is also more desirable than high pressure airless operation in some instances where the high pressure can actually blow off previous coats of material. Thus, there are many advantages in permitting the air atomizing gun to be converted for airless operation. With the modification of the present invention, the gun disclosed and described in the above identified patent application becomes a multi-purpose spray gun constructed to tolerate both pressures.

It is one object of the present invention to provide a multi-purpose, convertible spray gun for use in a plural component air atomizing or airless spray system.

Still another object of the present invention is to provide a multi-purpose spray gun in which an air atomizing spray gun is converted to airless operation by simple insertion of a sleeve and replacement of a nozzle tip.

Yet another object of the present invention is to provide a multi-purpose spray gun for conversion from air atomizing to airless operation which includes means for increasing the velocity of the component being sprayed after conversion.

These and other objects of the invention, advantages and novel features of the invention become apparent from the following detailed description of the invention when considered in conjunction with the accompanying drawings wherein like reference numbers identify like parts throughout.

DETAILED DESCRIPTION OF THE PREFERRED EMBODIMENT

Figure 1:
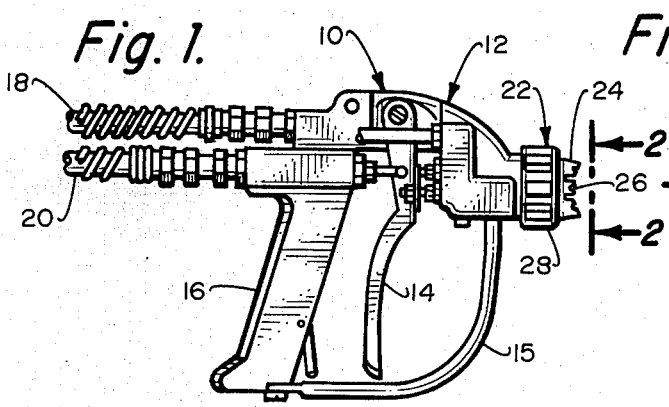
FIG. 1 is a side view of a plural component spray gun incorporating the invention.
Figure 2:
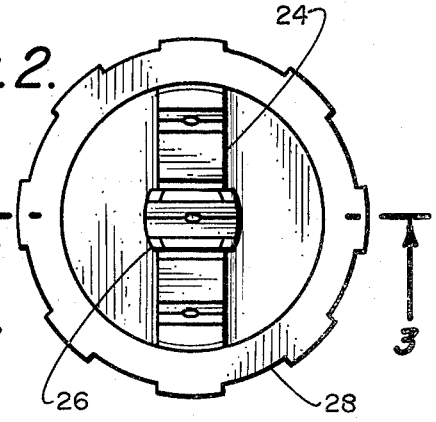
FIG. 2 is an end view of the nozzle of the spray gun of FIG. 1 taken at 2—2 of FIG. 1.
Figure 3:
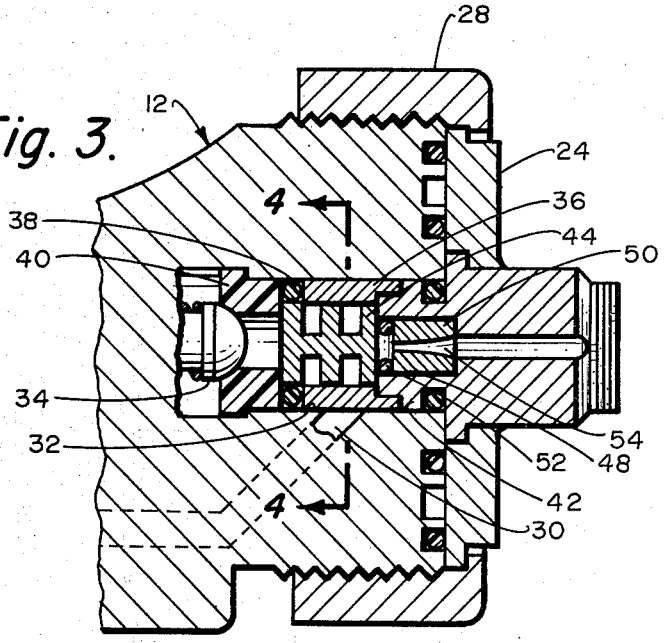
FIG. 3 is a partial sectional view of the nozzle assembly of the spray gun of FIG. 1.
Figure 4:
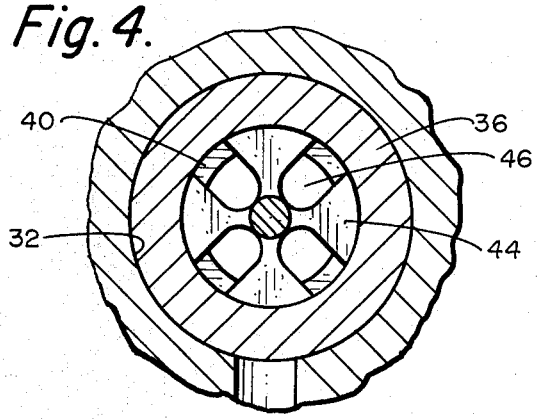
FIG. 4 is an enlarged partial section view taken at 4—4 of FIG. 3.
Figure 5:
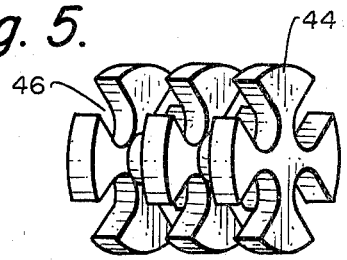
FIG. 5 is a detail of the mixing grid used in the spray gun of FIG. 1.

A plural component spray gun identical with the spray gun disclosed and claimed in the above identified patent is shown in FIG. 1 comprised of a handle body 10 and a nozzle body 12 for supplying or spraying catalyst and a resin. The gun body 10 has a trigger 14, trigger guard 15 and handgrip 16. The resin and catalyst components are supplied through hoses 18 and 20 through the handle body 10, and nozzle body 12 for spraying by nozzle assembly 22 comprised of nozzle tips 24 and 26 and retaining ring 28.

The nozzle body 12 is identical with the nozzle body disclosed in the prior patent which is converted for airless operation by interchanging parts. The modification to the spray gun assembly is shown in greater detail in FIGS. 2–5. The nozzle body 12 is provided with an air passageway 30 for delivering air to a chamber 32 normally used for atomizing the component delivered through valve 34. To convert the spray gun to airless operation, the original nozzle tip indicated at 26 is removed and changed and a sleeve 36 is inserted in the chamber 32 to seal the air passageway 30. This is important because although the air supply would be cut off during airless operation, no fluid component delivered through valve 34 can be allowed to back up into the air passage 30. In addition to the sleeve 36 and O-ring 38 between the end of valve seat 40 is provided for sealing purposes. The nozzle tip 26 is provided with an annular ring or flange 42 which holds the sleeve 36 securely in position in the chamber 32 compressing the O-ring 38, thus sealing and closing off the air passageway 30 preventing any back-up of the fluid component.

To provide a smooth, even delivery of the fluid component through the spray tip 26, a mixing grid 44 is provided which fits inside of the sleeve 36. The mixing grid 44 is shown in greater detail in FIGS. 4 and 5 and provides a plurality of projections having passageways 46 therebetween which stir and mix, i.e. breaks-up, the component as it is delivered to the nozzle tip 26. The mixing grid 44 is constructed to fit the cylindrical contour of the sleeve 36 and is also held in place by the annular flange 42 on the nozzle tip 26.

Thus, to convert the air atomizing gun of the above-identified patent to airless operation, the retaining ring 28 is removed, allowing removal of nozzle tips 24 and 26. The sleeve 36, O-ring 38 and mixing grid 44 are then slipped into the chamber 32. A new nozzle 26 is then inserted in the nozzle body 12 to retain the sleeve and seal the air passageway 30. The O-ring and nozzle tip 24 and retaining ring 28 are then replaced and the gun is now converted and ready for use in an airless operation at low pressures.

In some cases, in order to improve the fan pattern because of the varying component and low pressure being sprayed from the nozzle tip 26, a restriction in the orifice may be desirable to increase the velocity of fluid from the tip. To accomplish this, a cavity 48 is provided in the annular flange 42 of the nozzle tip 26. Into this cavity may be inserted an orifice restriction 50 and an O-ring 52 compressibly holding the orifice restriction 50 in place in the annular cavity 48. The amount of restriction can be varied by using different orifice restriction inserts 50 as desired. Preferably, the orifice 54 is in the form of a Venturi, to provide a smooth even flow and increase velocity of the of the fluid component to provide an improved fan pattern at low pressure.

Thus, there has been disclosed, a novel plural fluid component spray gun which is convertible from air atomizing at the nozzle tip to airless operation by simple insertion of a sleeve and means for sealing the air passageway to the air atomizing chamber. Additionally, means for varying the velocity of the component being spray are provided in the form of an orifice restriction.

Obviously, many modifications and variations of the invention are possible in light of the above teachings. It is therefore to be understood that the full scope of the invention is not limited to the details disclosed herein, but only by the claims, and may be practiced otherwise than as specifically described.

What is claimed is:

1. A convertible spray gun which is convertible from a air atomizing gun to a low pressure airless spray gun in which said spray gun has a handle body with a trigger for controlling the flow of plural fluid components supplied to a plurality of concentric nozzles, the improvement comprising:

an air atomizing chamber for atomizing one of said fluid components adjacent to the outlet to one of said nozzles;

air supply means including an air delivery passageway connected to said air atomizing chamber for supplying air to said air atomizing chamber when said gun is in the air atomizing configuration;

sealing means adapted to seal off said air supply to said air atomizing chamber to convert said gun to a low pressure airless type comprising:

sleeve insert means adapted to be slid into said air atomizing chamber to block said air delivery passageway;

interchangeable nozzle means having a centrally located flange adapted to abut said sleeve insert means to seal said air delivery passageway from the flow of a fluid component through said sleeve insert;

flow control assist means for controlling the flow of fluid through said sleeve to said nozzle whereby a uniform flow of said fluid component is supplied to said nozzle.

2. The spray gun according to claim 1 in which said flow control assist means includes restriction means for increasing the velocity of said fluid component flow through said nozzle.

3. The spray gun according to claim 1 in which said one or more nozzles comprises at least one centrally located nozzle having an annular flange extending into said air atomizing chamber; said annular flange adapted to hold said sleeve insert in said chamber to seal said air passageway.

4. The spray gun according to claim 1, including mixing means adapted to slip inside of said sleeve for mixing the component passing through said sleeve.

5. The spray gun according to claim 3, including mixing means adapted to slip inside of said sleeve for mixing the component passing through said sleeve.

6. The spray gun according to claim 4 in which said mixing means comprises a mixing grid.

7. The spray gun according to claim 1 in which said restriction means comprises an insert having a tapered orifice for insertion in said centrally located nozzle.

8. The spray gun according to claim 7 in which said annular extending flange has an annular cavity for receiving said tapered orifice insert.

9. The spray gun according to claim 7 in which said tapered orifice is a Venturi orifice.

10. The spray gun according to claim 8 in which tapered orifice is a Venturi orifice.

* * * * *